US007127993B2

(12) United States Patent
Otten

(10) Patent No.: US 7,127,993 B2
(45) Date of Patent: Oct. 31, 2006

(54) POSITIONING APPARATUS PROVIDED WITH A REGISTER FOR FLEXIBLE PRINTING PLATES

(75) Inventor: Petrus Johannes Marie Otten, Vlissingen (NL)

(73) Assignee: AV Flexologic B.V., AW Alphen A/D Rijn (NL)

( * ) Notice: Subject to any disclaimer, the term of this patent is extended or adjusted under 35 U.S.C. 154(b) by 0 days.

(21) Appl. No.: 10/845,756

(22) Filed: May 14, 2004

(65) Prior Publication Data

US 2005/0028702 A1 Feb. 10, 2005

(30) Foreign Application Priority Data

May 14, 2003 (NL) ..... 1023431

(51) Int. Cl.
*B41L 3/00* (2006.01)

(52) U.S. Cl. ..... 101/486; 101/484; 101/DIG. 36; 348/92; 348/95; 33/614; 33/617

(58) Field of Classification Search ..... 101/484–486, 101/DIG. 36; 348/92–95; 33/614–621
See application file for complete search history.

(56) References Cited

U.S. PATENT DOCUMENTS 4,520,389 A 5/1985 Hornschuh
4,653,369 A 3/1987 Dunsirn
4,932,320 A * 6/1990 Brunetti et al. ..... 101/181
4,945,829 A * 8/1990 Ericsson ..... 101/129
5,031,334 A * 7/1991 Takamura ..... 33/621
5,125,037 A 6/1992 Lehtonen et al.
5,488,781 A * 2/1996 Van Der Horst ..... 33/617
5,633,676 A * 5/1997 Harley et al. ..... 348/95
5,809,894 A * 9/1998 Goldstein ..... 101/486
5,850,789 A * 12/1998 Rudolf et al. ..... 101/486
6,640,716 B1 * 11/2003 Alonso et al. ..... 101/484

FOREIGN PATENT DOCUMENTS

EP 0 728 580 8/1996

* cited by examiner

*Primary Examiner*—Andrew H. Hirshfeld
*Assistant Examiner*—Jill E. Culler
(74) *Attorney, Agent, or Firm*—Bret E. Field; Bozicevic, Field & Francis LLP

(57) ABSTRACT

The invention relates to a positioning apparatus for positioning flexible printing plates on printing cylinders, wherein the printing plates are provided with at least one mark functioning as reference, wherein the apparatus comprises:

a support device for a printing cylinder;

at least one camera which is adapted to record the image of the at least one mark of the printing plate positioned on the printing cylinder; and a monitor for enlarged display of the image recorded by the at least one camera, wherein the positioning apparatus is provided with a registering device for registering the image recorded by the camera.

Using such a registering device it is possible to establish that the marks are located at the correct position. By making a copy of the data thus inputted into the register, evidence can be provided that the flexible printing plate is placed in the correct manner.

10 Claims, 2 Drawing Sheets

POSITIONING APPARATUS PROVIDED WITH A REGISTER FOR FLEXIBLE PRINTING PLATES

The invention relates to a positioning apparatus for positioning flexible printing plates on printing cylinders, wherein the printing plates are provided with at least one mark functioning as reference, wherein the apparatus comprises a support device for a printing cylinder, at least one camera which is adapted to record the image of the at least one mark of the printing plate positioned on the printing cylinder, and a monitor for enlarged display of the image recorded by the at least one camera.

Such an apparatus is known from EP-A-0 329 228.

Owing to increasing specialization, also in the graphic industry, there has developed a separation between companies specialized in arranging flexible printing plates on printing cylinders and companies which print the thus formed assemblies.

This separation is the cause of potential disagreement about whether or not the printing plate is correctly positioned.

It is therefore usual in the prior art to supply, together with a flexible printing plate placed on a printing cylinder, a trial print which shows that the flexible printing plate is properly placed.

Making such a trial print is time-consuming because the combination of printing cylinder and printing plate must be moved to a separate trial print machine, and inked, after which the trial print must be made. The printing plate must then be cleaned again before it can be sent to the printer. This requires a great deal of effort.

There is therefore a need for a different method of demonstrating that the flexible printing plate is fixed in correct manner on the printing cylinder.

This object is achieved in that the positioning apparatus is provided with a registering device for registering the image recorded by the at least one camera.

Using such a registering device it is possible to establish that the marks are located at the correct position. By making a copy of the data thus inputted into the register, evidence can be provided that the flexible printing plate is placed in the correct manner.

This does away with the necessity of making a trial print and the associated drawbacks.

It will be apparent that there must be two marks present on the printing plate for correct placing of the printing plate. In most cases the invention will therefore be implemented as a positioning apparatus provided with two cameras, wherein the monitor is adapted to display an image from both cameras, wherein the registering device is adapted to register the image recorded by both cameras.

In so-called registering of a printing device, it is however sufficient for only a single mark to be used. The use of the invention is also important for this purpose.

The invention provides the possibility of embodying the register as an image register, for instance in the form of a photo, or a so-called screen dump of the image displayed on the monitor.

Such a print can then be included as evidence of correct placing of the flexible printing plate.

It is however recommended that the registering device comprises a digital memory.

The evidence that the flexible printing plate is fixed in correct manner onto the printing cylinder can herein be included in digital form, in the form of a digital file which is provided for instance on a floppy disc or which can be sent via the internet.

The measures outlined above relate in the first instance to printing in a single colour.

In many cases multi-colour printing is applied.

The precise positioning is of perhaps even greater importance here so as to ensure that the colours in the produced printed material are in register.

The present invention provides for the option of storing the relation between cross hairs and marks for each of the colours.

The provides the option of storing the relation between cross hairs and marks for each of the colours.

The mutual relation between the marks, which is in fact most relevant for the final printed material being in register, is found to be best when the registering device is adapted for superimposed storage of a plurality of images recorded by the cameras.

It hereby becomes possible to store the position for each of the printing plates in a single "print", and this works particularly efficiently. In order to be able to distinguish the images of the different plates, it is recommended that the images relating to different printing plates are stored in a mutually differing colour.

Each of the printing plates is generally intended to print a single colour. Clarity is enhanced when the colours correspond to the colours in which the different printing plates must be printed.

Two cameras are generally applied; most printing plates are after all provided with two marks, this being sufficient to determine the position of a printing plate on a surface. In order to increase efficiency it is therefore attractive that the registering device is suitable for mutually adjacent storage of the image recorded by both cameras.

The invention also relates to a method for positioning a flexible printing plate on a printing cylinder, comprising the following steps of:

placing the printing plate on the printing cylinder;

sliding the printing plate on the printing cylinder until it has reached a position at which the images of the marks recorded by the cameras and displayed on the monitor coincide with the cross hairs projected in the image, which method is characterized in that the thus obtained images are stored in a register.

This method provides the option of submitting evidence of the correct positioning of the printing plates on the printing cylinder without trial prints having to be made.

This advantage is likewise achieved when a number of printing plates must each be successively positioned on a printing cylinder, which method is characterized in that the method according to the foregoing claim is applied for each of the printing plates, wherein use is made for reference purposes of the images of the marks of previously positioned printing plates stored in the register.

The advantage of avoiding trial prints is here even greater since a separate trial print would otherwise have to be made for each colour.

The present invention will be elucidated hereinbelow with reference to the annexed figures, in which:

FIGS. 1 and 2 show a positioning apparatus such as forms the subject-matter of the European patent application with publication number EP-A-0 329 228.

Figure 1:
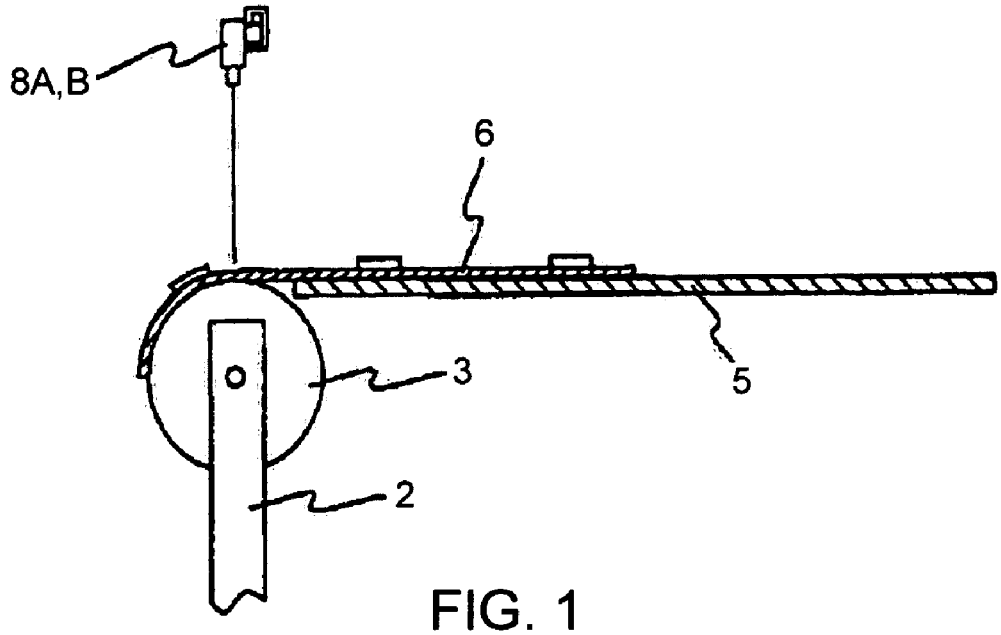
FIG. 1 PRIOR ART
FIG. 1 shows a cross-sectional view of a printing plate for positioning on a printing cylinder with the associated camera.
Figure 2:
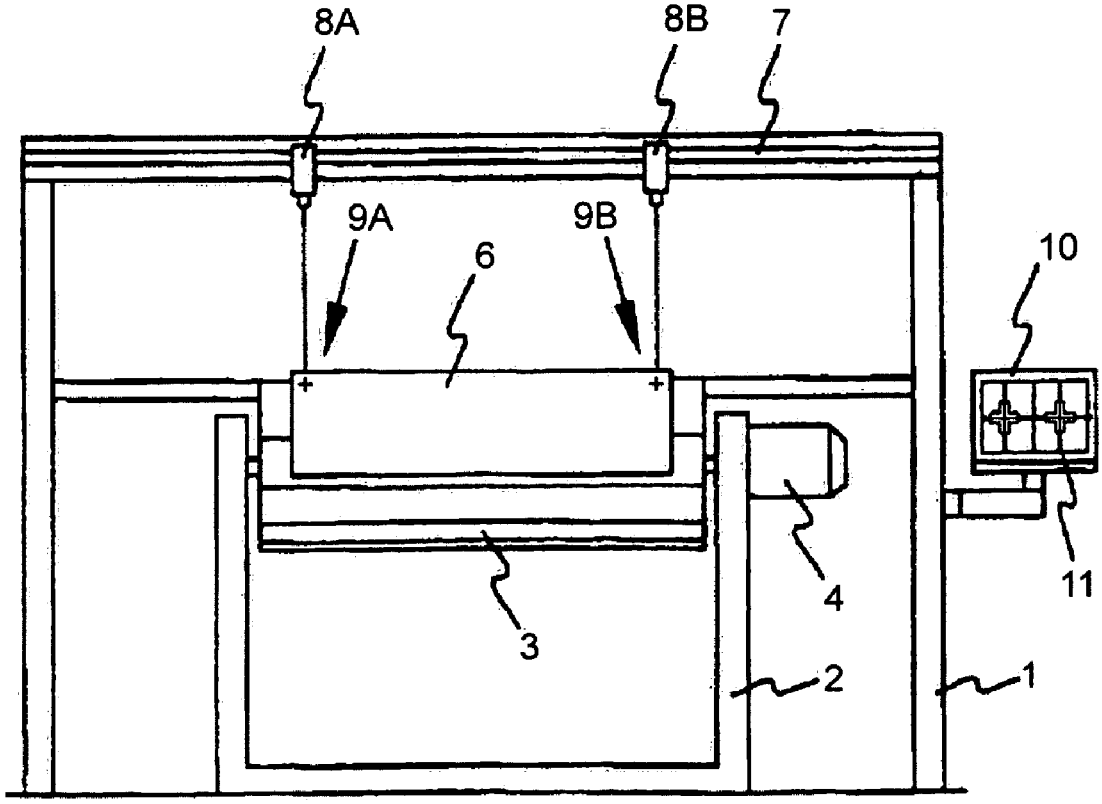
FIG. 2 PRIOR ART
FIG. 2 is a front view of the positioning apparatus shown in FIG. 1.

Because the apparatus per se forms part of the prior art, only as much as is necessary to understand the present invention is described in the present application.

The positioning apparatus comprises a frame 1 and a yoke 2. On yoke 2 is positioned a printing cylinder 3 which can be rotated by means of an electric motor 4 and an associated gear transmission.

A mounting table 5 is fixed to frame 1.

In order to enable correct positioning of a printing plate 6, frame 1 is provided with a rail 7 which extends parallel to the shaft of printing cylinder 3. Two cameras 8*a*, 8*b* are movable along rail 7. Owing to their mobility cameras 8*a*, 8*b* can be positioned precisely above the position at which, with correct placing, related markings 9*a*, 9*b* of printing plate 6 must be situated. A monitor 10 is arranged on the side of the frame to display the images recorded by cameras 8*a*, 8*b* respectively.

The apparatus further comprises a personal computer not shown in the drawing. When a printing plate 6 is placed, the data of the position of the marks, usually cross hairs, on printing plate 6 is entered into the computer. This will send cameras 8*a*, 8*b* to the relevant position and drive motor 4 such that printing cylinder 3 is situated in its neutral position.

Printing plate 6 can then be positioned in the manner already known from the above mentioned patent application. Use is made herein of the images displayed on monitor 10. Printing plate 6 is herein moved such that the markings 9*a*, 9*b* present thereon come to lie on image 10 with the cross hairs 11 projected thereon.

Figure 3:
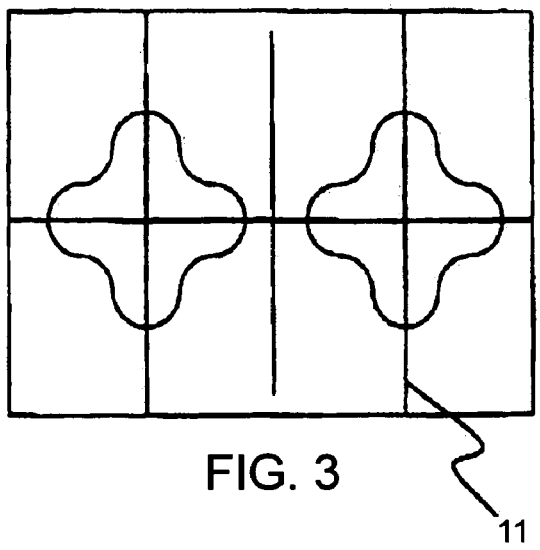
FIG. 3 shows an image displayed on the monitor of FIG. 2.

Such a situation is shown in FIG. 3. When the correct position has been reached, the flexible printing plate is attached to the printing cylinder, for instance by means of double-sided adhesive tape.

Registering can then take place. This entails storage, preferably in the form of a digital file, of the images present on the monitor after attachment of the printing plate to the printing cylinder. This digital file can be added to the combination of printing plate and printing cylinder, thereby demonstrating that the printing plate is fixed on the printing cylinder in correct manner.

In the case of multi-colour printing, these operations can be performed in the same manner, but the image can be stored cumulatively.

Figure 4:
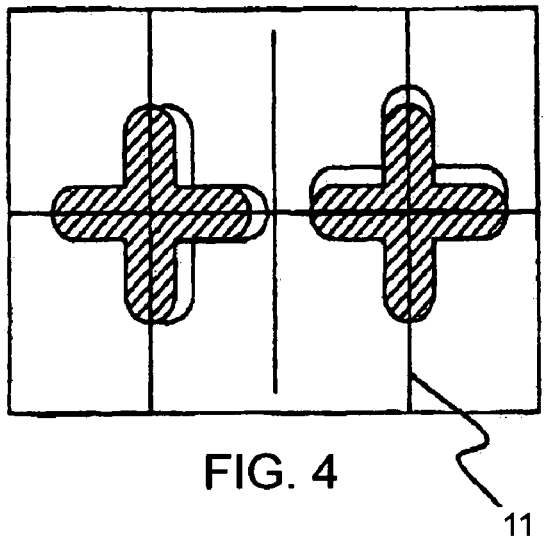
FIG. 4 shows a view corresponding with FIG. 3 during another operation.

It is otherwise also possible, when the first printing plate of an item of printed material is arranged on the relevant printing cylinder and the registering has taken place, to make use of the registering during arranging of the subsequent printing plate, for instance for printing a second colour. Such a situation is shown in FIG. 4, wherein the hatched crosses indicate the positions of the cross hairs present in the register and the open crosses indicate the situation of the second printing plate to be placed. It is apparent here that reference can be made not only to the cross hairs but also to the position of the previously placed printing plate.

Figure 5:
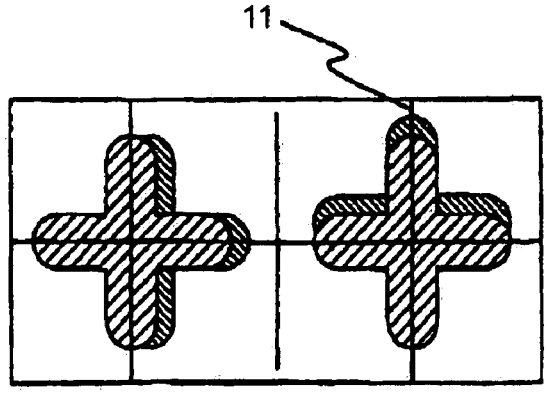
FIG. 5 shows a view corresponding with FIGS. 3 and 4 after the situation illustrated in FIG. 4 is registered.

Finally, FIG. 5 shows such a situation after registering has taken place. The diagonally hatched cross relates here to the first placed printing plate and the horizontally hatched cross to the second placed printing plate.

In order to show the difference, the second printing plate is shown slightly offset in the drawing relative to the first printing plate.

It will be apparent that numerous modifications can be made to the embodiment shown here. It is thus possible for instance to make use of different colours to designate the different printing plates used for different colours.

The invention claimed is:

1. Positioning apparatus for positioning flexible printing plates on printing cylinders, wherein the printing plates are provided with at least one mark functioning as a reference, wherein the apparatus comprises:

a support device for a printing cylinder;

at least one camera which is adapted to record the image of the at least one mark of the printing plate positioned on the printing cylinder; and a monitor for displaying the image recorded by the at least one camera, wherein the positioning apparatus is provided with a registering device for registering the image recorded by the camera, wherein the registering device is adapted to store more than one image recorded by the at least one camera and for super imposed storage of a plurality of images recorded by the at least one camera.

2. Positioning apparatus as claimed in claim 1, wherein the printing plate is provided with two marks, the apparatus comprises two cameras, that the monitor is adapted to display an image from each camera and the registering device is adapted to register the image recorded by both cameras.

3. Positioning apparatus as claimed in claim 2, wherein the registering device is suitable for mutually adjacent storage of the image recorded by both cameras.

4. Positioning apparatus as claimed in claim 1, wherein the registering device comprises a digital memory.

5. Positioning apparatus as claimed in claim 1, wherein the images recorded on each printing plate have a colour which is different than the colour of the images printed on the other printing plates.

6. Positioning apparatus as claimed in claim 5, wherein the colours correspond to the colours in which the different printing plates must be printed.

7. Positioning apparatus as claimed in claim 1, wherein the registering device is adapted for superimposed storage on the recorded image of cross hairs projected on the monitor for the purpose of positioning the printing plates on the printing cylinder.

8. Method for positioning a flexible printing plate on a printing cylinder, the printing plate having marks used as references, the method comprising:

placing the printing plate on the printing cylinder;

recording an image of the marks on the printing plate;

projecting cross hairs onto the image;

sliding the printing plate on the printing cylinder until it has reached a position at which the image of the marks coincide with the cross hairs;

storing the image in a registering device; and repeating the method for a plurality of printing plates, wherein the printing plates are successively placed on the printing cylinder and wherein the stored images of the marks on previously positioned printing plates are used as references.

9. Method as claimed in claim 8, wherein the images are recorded by a camera.

10. Method as claimed in claim 8, further comprising displaying the recorded images on a monitor.

* * * * *